US006909962B2

(12) United States Patent
Huang et al.

(10) Patent No.: US 6,909,962 B2
(45) Date of Patent: Jun. 21, 2005

(54) TRAFFIC SAFETY CAUTION APPARATUS FOR DISTINGUISHING RUNNING DIRECTION OF VEHICLES

(76) Inventors: Zexiu Huang, House A, 21/F., jingxie Building, No. 8, Shenqi Road, Guiyang City, Guizhhou Province, 550002 (CN); Shanshan Zhang, House A, 21/F., jingxie Building, No. 8, Shenqi Road, Guiyang City, Ghizhou Province, 550002 (CN)

( * ) Notice: Subject to any disclaimer, the term of this patent is extended or adjusted under 35 U.S.C. 154(b) by 108 days.

(21) Appl. No.: 10/415,426

(22) PCT Filed: Oct. 16, 2001

(86) PCT No.: PCT/CN01/01483

§ 371 (c)(1),
(2), (4) Date: Sep. 12, 2003

(87) PCT Pub. No.: WO02/37445

PCT Pub. Date: May 10, 2002

(65) Prior Publication Data

US 2004/0030489 A1 Feb. 12, 2004

(30) Foreign Application Priority Data

Oct. 31, 2000 (CN) ..... 00 2 44858 U

(51) Int. Cl.[7] ..... G08G 1/09; G08G 1/0968

(52) U.S. Cl. ..... 701/117; 701/119; 340/905; 348/149; 180/167

(58) Field of Search ..... 701/2, 93, 117, 701/118, 119; 340/905, 902, 936; 455/553.1, 93, 96; 375/135, 136, 146, 147; 379/111, 112.01; 348/148, 149; 180/167, 169

(56) References Cited

U.S. PATENT DOCUMENTS 5,493,291 A * 2/1996 Bruggemann ..... 340/905
5,594,432 A 1/1997 Oliva et al. ..... 340/905
5,729,214 A 3/1998 Moore ..... 340/905
6,008,740 A 12/1999 Hopkins ..... 340/905
6,246,948 B1 * 6/2001 Thakker ..... 701/93

FOREIGN PATENT DOCUMENTS

| | | |
|---|---|---|
| CN | 2047428 | 11/1989 |
| CN | 2223854 | 4/1996 |
| CN | 1147661 | 4/1997 |
| DE | 19500114 | 7/1996 |
| EP | 432680 | 6/1991 |
| EP | 583131 | 2/1994 |
| EP | 1629983 | 12/1994 |
| EP | 853237 | 7/1998 |

* cited by examiner

*Primary Examiner*—Tan Q. Nguyen
(74) *Attorney, Agent, or Firm*—Patterson, Thuente, Skaar & Christensen, P.A.

(57) ABSTRACT

The present invention discloses a traffic caution apparatus which may distinguish the running direction of vehicles. The apparatus includes a transmitter and a receiver. The transmitter an ultrasonic transmitting unit and a FM stereo transmitting unit. The receiver includes a FM stereo receiving unit, a decoding unit, an ultrasonic receiving unit, a monolithic processor, an analogy switch, a speed recording/reproducing unit, a given voltage unit. The apparatus uses ultrasonic wave to distinguish running direction and speed of vehicles, and can send caution speech information with accuracy to a vehicle whose speed must be limited. The apparatus has expandable function which may provide other caution information, large number of travel and business information to vehicles. This apparatus may substitute travel caution signs.

6 Claims, 4 Drawing Sheets

TRAFFIC SAFETY CAUTION APPARATUS FOR DISTINGUISHING RUNNING DIRECTION OF VEHICLES

FIELD OF THE INVENTION

This invention relates to a traffic safety caution apparatus, and more particularly to a traffic safety caution apparatus having function of distinguishing the running direction of a vehicle.

DESCRIPTION OF THE RELATED ART

As an improvement of road quality, the running speed of a vehicle is increased continually. Meanwhile, the number of traffic accidents is also increasing. One of the important factors is that the drivers do not follow the requirements of the traffic safety caution. Also, some traffic accidents are caused due to the caution signs not being noticed by the drivers. Conventional traffic safety caution signs are visual signals such as marks, characters or light. In most case, such a traffic safety caution sign has disadvantages which could not make drivers pay sufficient attention to it, and the traffic safety caution signs scatter the attention of the driver in driving. The possibility of accidents is therefore increased.

SUMMARY OF THE INVENTION

It is therefore an object of the invention to provide a traffic safety caution apparatus which can distinguish the running direction of vehicles with ultrasonic wave, provide vehicles with various safety caution information in associate with the site where a vehicle is located, thereby overcoming the disadvantages in prior art. Further, the traffic safety caution apparatus of the invention can be developed to supply other kinds of prompting information.

According to one aspect of the invention, the traffic safety caution apparatus having the function for distinguishing the running direction of vehicles comprises a transmitter and a receiver, the transmitter comprises a vehicle detect enabling means, a power supply, a stereo frequency-modulation (FM) receiving means, a speech recording/reproducing means, a stereo encoding means, a FM amplification transmitting means, an ultrasonic frequency stabilization oscillating means, and an ultrasonic transmitting head; wherein said vehicle detect enabling means directly connecting to said power supply, said vehicle detect enabling means used for controlling the on/off of the power supply and of respective portions of the transmitter based on the detected noise signal from a vehicle, an output channel of said stereo frequency-modulation (FM) receiving means for receiving input speech signal connecting to said speech recording/reproducing means, an output of said speech recording/reproducing means connecting to said stereo encoding means, an output of said stereo encoding means connecting to said FM amplification transmitting means for transmitting FM signal, said ultrasonic frequency stabilization oscillating means connecting to the ultrasonic transmitting head transmitting ultrasonic wave; and The receiver comprises a stereo frequency-modulation (FM) receiving means for receiving FM signal transmitted from the transmitter; a set of analog switches; a processor; a speech recording/reproducing means; a remote control receiving means; a remote control decoding means; a quad-latch; a resistor array; an ultrasonic receiving head; an ultrasonic frequency selective amplifying means; a frequency-voltage converting means; a reference voltage generator; and a power amplifying speaker; wherein an output channel of the stereo FM receiving means connecting to a first input of a first analog switch controlled by the processor, a second input of the first analog switch connecting to an output of the speech recording/reproducing means, the speech output of the first analog switch connecting to the speech recording/reproducing means, the reproducing output of the first analog switch connecting to the power amplifying speaker, a identity code output of the first analog switch connecting to the remote control receiving means; the output of the remote control receiving means connecting to the remote control decoding means; the output of the remote control decoding means connecting to the quad-latch of which an output in turn connects to the processor, and the other output of which connects to an input of a second analog switch; a resistor array connecting to the other input of the second analog switch; a gate level signal output of the second analog switch connecting to an input of a third analog switch, and another input of the third analog switch connecting to the output of the reference voltage generator; an output of the ultrasonic receiving means, which is composed of an ultrasonic receiving head for receiving ultrasonic signals transmitted from the transmitter, the ultrasonic frequency selective amplifying means for performing frequency selection and amplifying the output of the ultrasonic receiving head, and frequency-voltage converting means for receiving the output from the ultrasonic frequency selective amplifying means and converting the output into digital pulse signals, connecting to another input of the third analog switch; and another input of the speech recording/reproducing means connecting to the processor via the first analog switch.

In the traffic safety caution apparatus which may distinguish the running direction of vehicles, in the transmitter, the vehicle detection enabling means includes a detecting microphone MIC, a sound detecting integrated circuit IC7, a transistor Q4 and a delay reset relay J; the stereo FM receiving means includes a receiving antenna AN1, a stereo FM receiving integrated circuit IC1; the speech recording/reproducing means includes a speech recording/reproducing integrated circuit IC4; the stereo encoding means includes a stereo encoding integrated circuit IC6; the FM amplifying transmitting means includes three transistors Q1 to Q3 and a transmitting antenna AN2; the ultrasonic frequency stabilization oscillating means includes a crystal oscillator Y3, "NOT" circuits IC2/*b*, IC2/*c* and IC2/*d*, and a power transistor Q5; the ultrasonic transmitting head includes an ultrasonic transmitting sensor Y4. In the receiver, the stereo FM receiving means includes a receiving antenna AN3 and a stereo FM receiving integrated circuit IC8; the analog switches include a analog switch which is composed of a four-tap analog switch IC12 and a transistor Q7, and analog switches IC14, IC13 and IC21; the processor may be a microprocessor IC22; the speech recording/reproducing means includes a speech recording/reproducing integrated circuit IC20; the remote control receiving means includes a remote control demodulation integrated circuit IC18; the remote control decoding means includes a remote control decoding integrated circuit IC17; the quad-latch includes dual D-type trigger integrated circuit IC15, IC16; the ultrasonic receiving head includes an ultrasonic receiving sensor Y8; the ultrasonic frequency selective amplifying means includes a plurality of operational amplifiers IC26, IC25 and IC24; the frequency-voltage converting means includes a frequency-voltage converter IC23; the reference voltage generator includes a resistor R47 and a stable voltage diode D39; and the power amplifying speaker includes a power amplifying integrated circuit IC11 and a speaker SP.

Further, in the transmitter, a speech recording/reproducing means is connected between the other output channel of the stereo FM receiving means and stereo encoding means, a recording/reproducing switch circuit is connected between the control signal input of the stereo FM receiving means and the speech recording/reproducing means. In the receiver, the other output channel of the stereo FM receiving means is connected to a MP3 player. One of the inputs of the MP3 player is connected to the processor, and the other input thereof is connected to the quad-latch. The output of the MP3 player is connected to the first analog switch.

Further, in the transmitter, the speech recording/reproducing means may include a speech recording/reproducing integrated circuit IC5; the recording/reproducing switch circuit includes a "NOT" circuit IC2/*a* and an analog switch IC3. In the receiver, the MP3 player includes a MP3 player IC10.

Furthermore, the receiver may further comprise a weather detecting means including a sensor for detecting weather and a analog switch connected to the output of the sensor and controlled by the processor, wherein two control signal outputs of the analog switch are connected to the speech recording/reproducing means, the data output of the analog switch is connected to the processor; the power amplifying speaker in the receiver is connected to a volume incrementing means of which a control signal input is connected to the analog switch connecting between the speech recording/reproducing means and the processor.

The sensor in the receiver is a temperature sensor T; the analog switch includes a four-tap analog switch IC19 and a transistor Q6; and the volume incrementing means is a count dividing frequency integrated circuit IC9.

The traffic safety caution apparatus which may distinguish the running direction of vehicles according to the present invention may not only distinguish the running direction of vehicle through ultrasonic wave by using the Doppler effect, but also provide the associated vehicle with traffic safety caution information, and supply the speed-limited vehicles with the speed-limited reference as compared with the prior art.

Also, the traffic safety caution apparatus according to the present invention has an expandable function as an information platform. Various safety cautioning information may be added to the traffic safety caution apparatus of the invention, and travelling and commercial information may also be supplied to the vehicles passed through the apparatus according to the present invention. The traffic safety caution apparatus of the invention can be made with efficient-cost. Further, the traffic safety caution apparatus according to the present invention can be used as speech prompting apparatus in addition to traffic safety caution flag.

BRIEF DESCRIPTION OF THE DRAWINGS

Above and other objects and advantages of the present invention will become apparent and more readily appreciated from the following description of the embodiments, taken in conjunction with the accompany drawings, in which.

DETAILED DESCRIPTION OF THE REFERENCE EMBODIMENTS

Reference will be made in detail to the embodiments of the present invention, examples of which are illustrated in the accompanying drawings. The traffic safety caution apparatus according to the present invention comprises a transmitter and a receiver.

Figure 1:
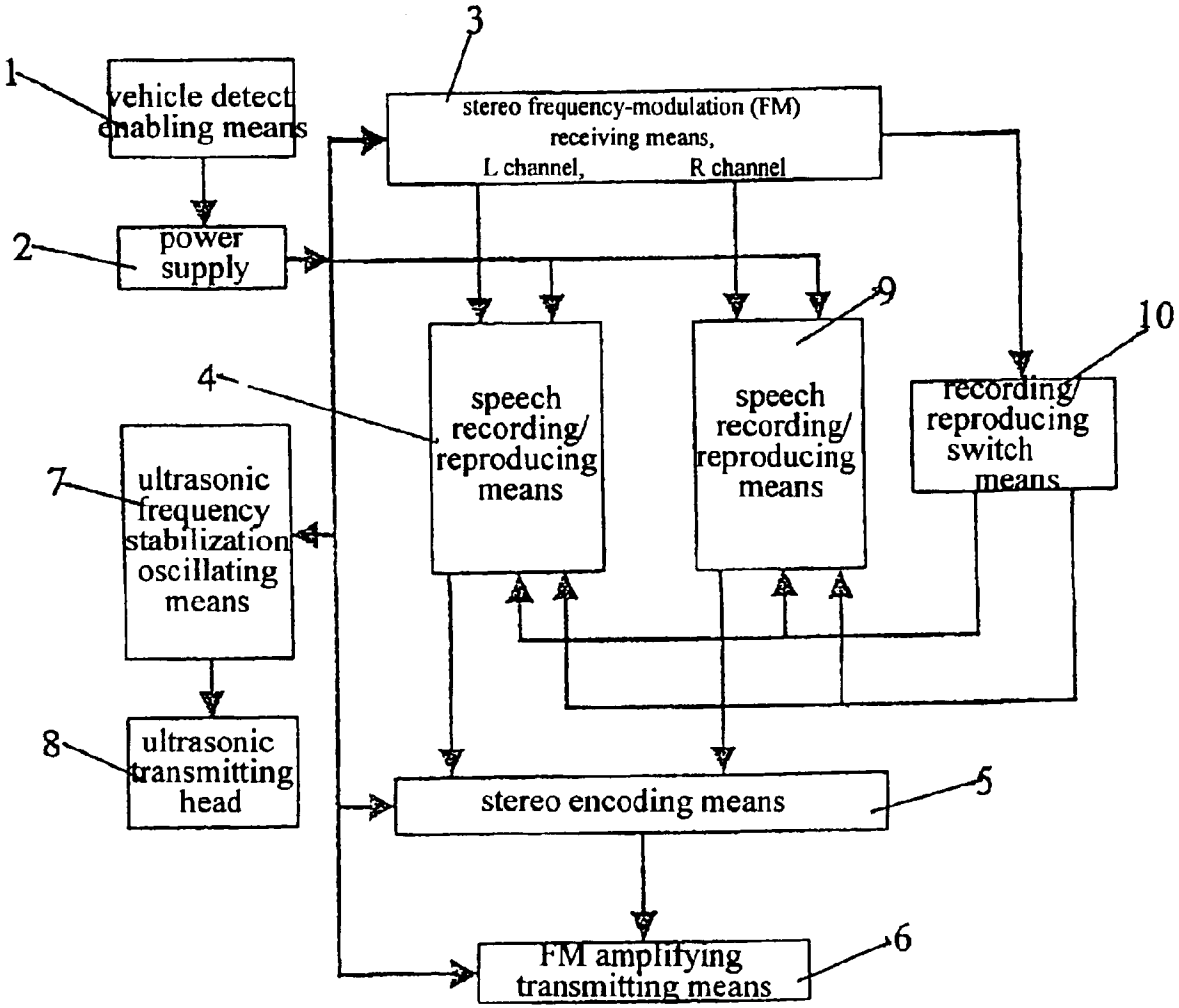
FIG. 1 is a block diagram showing the configuration of the transmitter of the traffic safety caution apparatus according to an embodiment of the invention.

FIG. 1 shows the block diagram of the transmitter of the traffic safety caution apparatus according to an embodiment of the invention. As shown in FIG. 1, the traffic safety caution apparatus comprises a vehicle detection enabling unit 1, a power supply 2, a stereo frequency-modulation (FM) receiving unit 3, speech recording/reproducing units 4, 9, a recording/reproducing switch unit 10, a stereo encoding unit 5, a FM amplifying transmitting unit 6, an ultrasonic frequency stabilization oscillating unit 7, and an ultrasonic transmitting head 8. The vehicle detection enabling unit 1 is directly connected to the power supply 2 so that to control the output of the power supply and on/off state of respective portions of the transmitter based on the noise signal detected by vehicle detection enabling unit 1 from the vehicle. An output channel (e.g., left channel) of the stereo frequency-modulation (FM) receiving unit 3 which receives speech input signal is connected to the speech recording/reproducing unit 4 of which an output in turn connects with an input of the stereo encoding unit 5. Another output channel (e.g., right channel) of stereo FM receiving unit 3 is connected to the speech recording/reproducing unit 9 of which in turn connects with another input of the stereo encoding unit 5. The control signal output of the stereo FM receiving unit 3 is connected to the speech recording/reproducing unit 4 and speech recording/reproducing unit 9 through the recording/reproducing switch unit 10. The output of the stereo encoding unit 5 is connected to the input of the FM amplifying transmitting unit 6 which transmits FM signal. The ultrasonic signal output of the ultrasonic frequency stabilization oscillating unit 7 is connected to the ultrasonic transmitting head 8, and the ultrasonic transmitting head 8 transmits ultrasonic wave.

Figure 2:
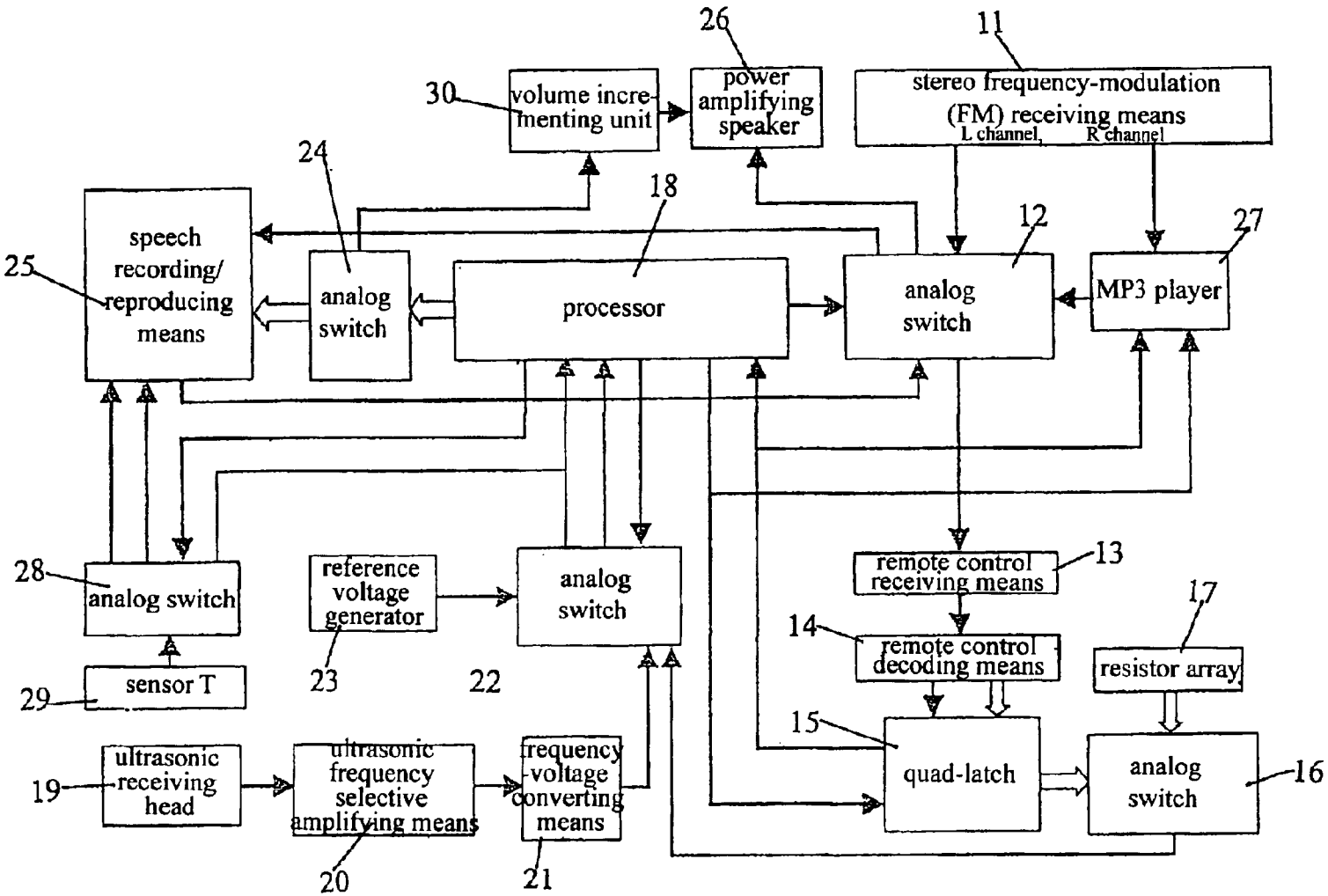
FIG. 2 is a block diagram showing the configuration of the receiver of the traffic safety caution apparatus according to an embodiment of the invention.

Referring to FIG. 2, the receiver comprises a stereo frequency modulation (FM) receiving unit 11, analog switches 12, 16, 22, 24, and 28, a processor 18, a MP3 player 27, a speech recording/reproducing unit 25, a remote control receiving unit 13, a remote control decoding unit 14, a quad-latch 15, a resistor array 17, an ultrasonic receiving head 19, an ultrasonic frequency selective amplifying unit 20, a frequency-voltage converter 21, a reference voltage generator 23, a sensor 29, a volume incrementing unit 30, and a power amplifying speaker 26. In the receiver, an output channel (e.g. left channel) of the stereo FM receiving unit 11 is connected to an input of analog switch 12 controlled by the processor 18. The other input of analog switch 12 is connected to the reproducing output of the speech recording/reproducing unit 25. The speech output of analog switch 12 is connected to the speech recording/reproducing unit 25 while the reproducing output and identity code output of the analog switch 12 are connected to the power amplifying speaker 26 and the remote control receiving unit 13 respectively. The output of the remote control receiving unit 13 is connected to remote control decoding unit 14 of which the output in turn connects with quad-latch 15. One of the outputs of quad-latch 15 is connected to the processor 18, and the other output is connected to the analog switch 16. As an example, a computer or a microprocessor may be used as the processor 18. An input of the analog switch 16 is connected to the resistor array 17, and the gate level signal output is connected to an input of the analog switch 22. Another input of the analog switch 22 is connected of the output of the reference voltage generator 23, and the still another input of analog switch 22 is connected to the output of ultrasonic receiving unit. The ultrasonic receiving unit may be composed of an ultrasonic receiving head 19 which receives ultrasonic wave signal transmitted from transmitter, an ultrasonic frequency selective amplifying unit 20 which performs frequency selection and amplifies the selected signals, and a frequency-voltage converter 21 which receives the output of the ultrasonic frequency selective amplifying unit 20 and converts the output into digital pulse signals. The still another input of the speech recording/reproducing unit is connected to the processor 18 via the analog switch 24. Another output of the stereo FM receiving unit 11 in the receiver is connected to the MP3 player 27. The two control signal inputs of the MP3 player are connected to the processor 18 and quad-latch 15 respectively, and the speech output of the MP3 player is connected to the analog switch 12.

Further, the receiver comprises a weather detecting unit. The weather detecting unit includes a sensor 29 for detecting weather and a analog switch 28 connected to the output of the sensor 29 and controlled by the processor 18. The two control signal outputs of analog switch 28 are connected to the speech recording/reproducing unit 25, the data output of the analog switch 28 is connected to the processor 18.

The power amplifying speaker in the receiver is connected to a volume incrementing unit of which control signal input is connected to the analog switch 24.

Figure 3:
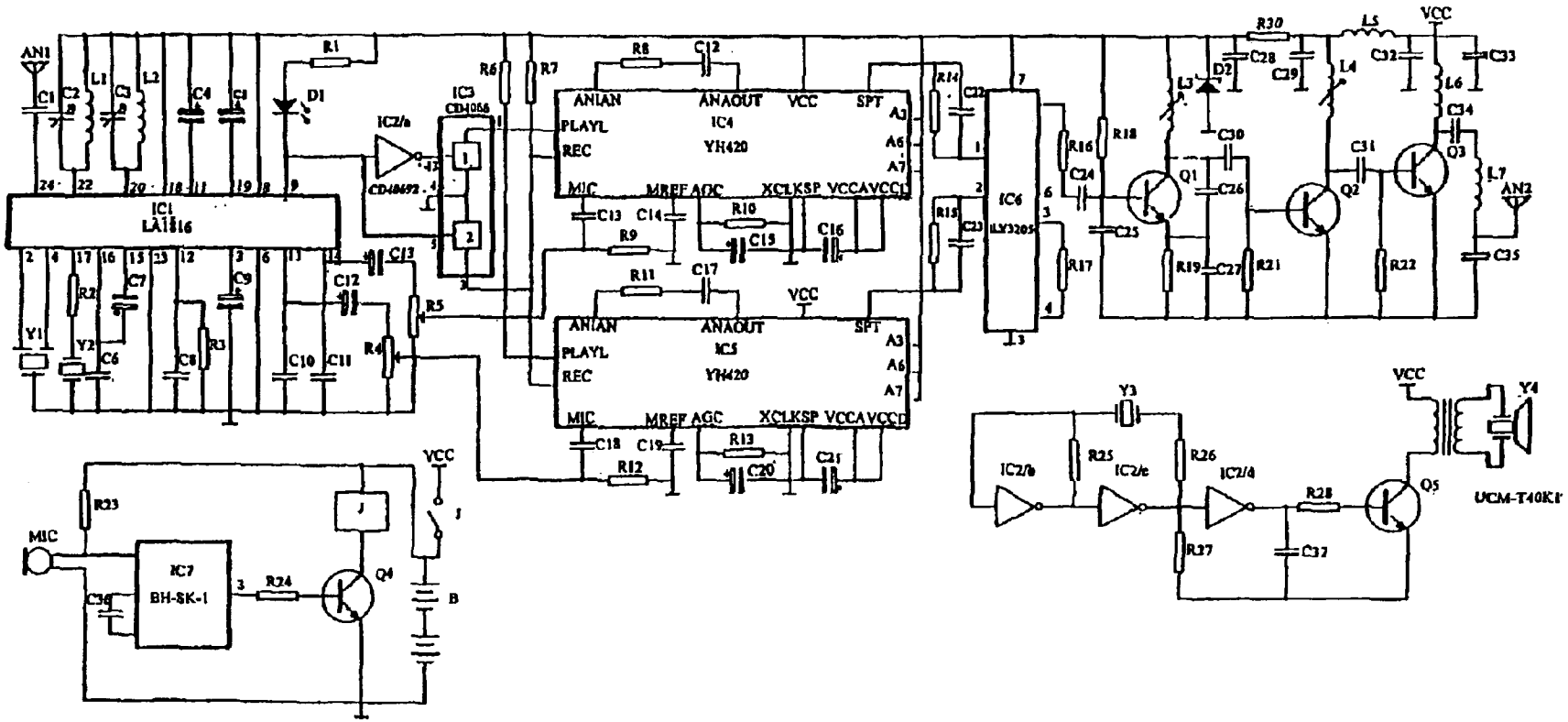
FIG. 3 shows the circuit diagram of transmitter of the traffic safety caution apparatus according to an embodiment of the invention.

FIG. 3 shows the circuit diagram of transmitter of the traffic safety caution apparatus according to an embodiment of the invention. The vehicle detection enabling unit 1 may include a detecting microphone MIC, a sound detecting integrated circuit IC7, a transistor Q4 and a delay reset relay J. The relay J closes when the detecting microphone MIC detects the noise from the vehicle. A battery unit may be used as the power supply of the transmitter. The power supply is automatically switched off for a delay, e.g. 12 seconds, if there is no vehicle. The stereo FM receiving unit 3 may include a receiving antenna AN1, a stereo FM receiving integrated circuit IC1. The speech recording/reproducing unit 4 may include a speech recording/reproducing integrated circuit IC4. The speech recording/reproducing unit 9 may include a speech recording/reproducing integrated circuit IC5. The recording/reproducing switch unit 10 may include a "NOT" circuit IN2/*a* and a analog switch IC3. The stereo encoding unit 5 may include a stereo encoding integrated circuit IC6. The FM amplifying transmitting unit 6 may include transistors Q1, Q2, and Q3 and transmitting antenna AN2. The ultrasonic frequency stabilization oscillating unit 7 may include a crystal oscillator Y3, "NOT" circuits IC2/*b*, IC2/*c* and IC2/*d*, and a power transistor Q5. An ultrasonic transmitting sensor Y4 may be used as the ultrasonic transmitting head 8.

Figure 4:
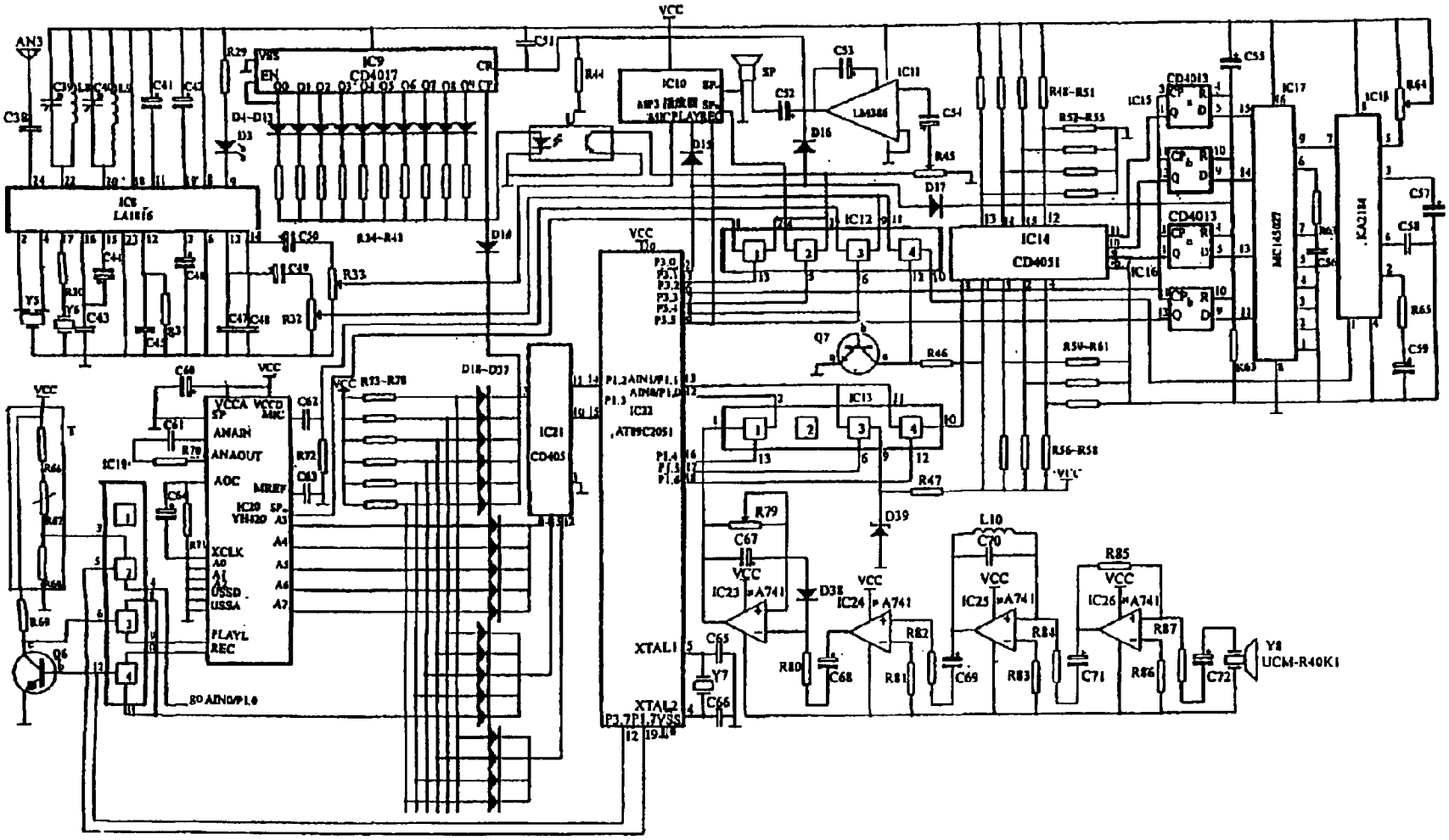
FIG. 4 shows the circuit diagram of the receiver of the traffic safety caution apparatus according to an embodiment of the invention.

FIG. 4 shows the circuit diagram of receiver of the traffic safety caution apparatus according to an embodiment of the invention. As shown in FIG. 4, the stereo FM receiving unit 11 may include a receiving antenna AN3 and a stereo FM receiving integrated circuit IC8. Analog switch 12 may include a four-tap analog switch IC2 and a transistor Q7, and integrated circuits IC14, IC13 and IC21 may be used as the analog switches 16, 22, and 24 respectively. The processor 18 may be, for example, a microprocessor IC22. The speech recording/reproducing unit may include a speech recording/reproducing integrated circuit IC20. A remote control demodulation integrated circuit IC18 may be used as the remote control receiving unit 13. A remote control decoding integrated circuit IC17 may be used as the remote control decoding unit 14. The quad-latch 15 is composed of dual D-type trigging integrated circuits IC15 and IC16. An ultrasonic receiving sensor Y8 may be used as the ultrasonic receiving head 19. The ultrasonic frequency selective amplifying unit 20 may be composed of operational amplifiers IC26, IC25 and IC24. The frequency-voltage converter IC23 may be used as the frequency-voltage convert unit 21. The reference voltage generator 23 may include a resistor R47 and a voltage stabilizing diode D39. The processor 18 distinguishes the running direction of a vehicle based on the frequency change of the received ultrasonic wave. The power amplifying speaker may include a power amplify integrated circuit IC11 and a speaker SP. A MP3 player IC10 may be used as the MP3 player in the receiver. A temperature sensor T may be used as the sensor 29 used for detecting weather. The analog switch 28 may include a four-tap analog switch IC19 and a transistor Q6. A count dividing frequency integrated circuit IC9 may be used as the volume incrementing unit 30.

Next, the operation of the transmitter of the traffic safety caution apparatus of the invention will be described. The transmitter is provided at side of the road where It is needed to prompt information. The receiver of the traffic safety caution apparatus is provided at a vehicle. The relay J in the transmitter closes when the detecting microphone MIC detects noise from the vehicle. Battery unit supplies the transmitter with power, and then the transmitter operates. The stereo encoding integrated circuit IC6 modulates the audio signal supplied from the speech recording/reproducing integrated circuits IC4, IC5 into FM signals with frequency of 88 MHz. The resultant signal is amplified by transistors Q1, Q2 and Q3, and then transmitted by a directional antenna to the direction from which the vehicle comes. At this time, the crystal oscillator Y3 generates ultrasonic wave with frequency of 40 KHz, and then transmitted by an ultrasonic sensor such as sensor UCM-T40K1 to the direction to which the vehicle runs. The stereo frequency modulation wave on which two kinds of speech information are modulated is transmitted if it is necessary to input new speech information or update the existing speech information. The stereo FM receiving integrated circuit IC1 receives and demodulates the modulated speech information such as caution information and commercial information, and then supplies demodulated speech information to the double-channel speech recording/reproducing unit which may include the speech recording/reproducing integrated circuit IC4 and IC5, thereby recording the information therein. In the present embodiment, integrated circuit IC4 records identity code and speech such as traffic safety caution information, IC5 records the speech such as travelling information and commercial information. The recorded speech is cyclically played back under the control of the recording/reproducing switch unit 10.

Next, the operation of the receiver of the traffic safety caution apparatus of the invention will be described. The receiver is in operation all the time. The stereo FM receiving integrated circuit IC8 receives the FM signal including left channel signal and right channel signal transmitted from the transmitter via receiving antenna AN3. The left channel signal includes identity code and speech relating to traffic safety caution. The right channel signal includes speech relating to travelling and commercial information. Under the control of microprocessor IC22, the analog switch IC12 input the identity code included in the left channel to remote control receiving demodulation integrated circuit IC18 to demodulate, and then send the demodulated identity code to remote control decoding integrated circuit IC17. The remote control decoding integrated circuit IC17 decodes the demodulated identity code. After that, the decoded identity code is sent to four-digit quad-latch 15 which is composed of dual D-type trigger integrated circuits IC15, IC16 if the identity code is valid. Quad-latch 15 has three output taps: one of the output taps is sent to the microprocessor IC22 for providing a handshake signal. The microprocessor IC22 sends three branches of signals after receiving the handshake signal. The first branch of signal from the microprocessor IC22 resets the MP3 player IC10, switches the analog switch IC for inputting the left channel signal (traffic safety caution speech) into the speech recording/reproducing integrated circuit IC20, and turns on the analog switch IC21 so that to make the speech recording/reproducing integrated circuit IC20 reset and record the signal from the left channel. The second branch of signal from the microprocessor IC22 is sent to the MP3 player IC10, and controls the MP3 player IC10 to record the signal from the right channel. The third branch of signal from the microprocessor IC22 is input to the analog switch IC14, thereby making the analog switch IC14 select respective speed-limited voltage signal from the resistor array 17 (the resistor array 17 provides, e.g., seven speed-limited reference voltages from 30 km to 100 km and a non-speed-limited reference voltage), and send the selected speed-limited voltage signal to the analog switch IC13. The ultrasonic receiving sensor Y8 receives an ultrasonic signal transmitted from the transmitter located at the side of the road when the vehicle passes the transmitter. The received ultrasonic signal is input to the ultrasonic frequency selective amplifying unit 20 which in turn sends to frequency-voltage converter 21. The received ultrasonic signal is converted to a corresponding voltage signal (i.e., a voltage corresponding to a speed) in the frequency-voltage converter 21, and then sends the converted voltage signal to the analog switch IC13. The Under the control of the microprocessor IC22, the analog switch IC13 sends the input speed voltage and a reference voltage (which is generated with simulating 40 KHg ultrasonic wave) generated by the reference voltage generator 23 to the microprocessor IC22 to perform comparison therein. The microprocessor can distinguish the running direction of a vehicle based on the frequency change of the received ultrasonic wave. The comparison is carried out based on Doppler effect, i.e., as the change of the vehicle speed, the ultrasonic wave received by the receiver in the vehicle from a fixed location is changed. It indicates that a vehicle is running toward the ultrasonic transmitter when the speed voltage is higher than the reference voltage, and the vehicle is away from the transmitter when the speed voltage is lower than the reference voltage. In the embodiment, it may define that a speed-limited operation is started when a vehicle runs away from a transmitter. When a vehicle runs into a speed-limited section, the microprocessor IC22 controls the analog switch IC13 to feed the speed-limited voltage selected by the analog switch IC14 and the speed voltage output from IC23 of the frequency-voltage converter 21 into the microprocessor IC22 to perform comparison. The microprocessor IC22 controls the analog switch IC21 to make the speech recording/reproducing integrated circuit IC20 reproduce speech relating to speed-limited caution while the microprocessor IC22 controls the analog switch IC12 to make the speech relating to speed-limited caution be played back through the power amplifying circuit IC11. Further, the microprocessor IC22 starts the volume incrementing circuit IC9 through the analog switch IC21 to make the played volume increment every a predetermined interval until the vehicle speed reaches the limited speed. The speech relating to safety caution is stopped when the vehicle speed is lower the limited speed.

An air temperature sensor T converts the change of the temperature into a corresponding voltage value, and then sends the voltage value to the microprocessor IC22 via the analog switch IC19. The microprocessor IC22 reads the voltage value and then compares the voltage value with the reference voltage value read from the reference voltage generator 23 via the analog switch IC13. In the case where the air temperature is lower than a threshold predetermined in advance, the weather prompting information is reproduced from the speech recording/reproducing integrated circuit IC20 through the analog switches IC21, IC12 every a predetermined interval if no speed-limited caution information is played. The microprocessor IC22 may control the MP3 player IC10 to play travelling or commercial information through the analog switch IC22 if no speed-limited caution information and weather prompting information is played.

Although embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A traffic safety caution apparatus having the function for distinguishing the running direction of vehicles, including a transmitter and a receiver:

said transmitter including a power supply;

a vehicle detect enabling means connecting with the power supply for controlling the on/off state of the power supply and of respective portions of the transmitter based on the detected noise signal from a vehicle;

a stereo frequency-modulation (FM) receiving meant for receiving an input speech signal;

a speech recording/reproducing means operably coupled with an output channel of the stereo FM receiving means;

an FM amplifying transmitting means for transmitting an FM signal;

a stereo encoding means operably coupled to the FM amplifying transmitting means;

an ultrasonic transmitting head for transmitting an ultrasonic wave;

an ultrasonic frequency stabilization oscillating means operably coupled to the ultrasonic transmitting head; and said receiver including a stereo frequency-modulation (FM) receiving means (11) for receiving the FM signal transmitted from the transmitter;

a set of analog switches (12, 16, 22, 24);

a speech recording/reproducing means (25);

a remote control receiving means (13);

a remote control decoding means (14);

a quad-latch (15);

a resistor array (17);

an ultrasonic receiving head (19);

an ultrasonic frequency selective amplifying means (20);

a frequency-voltage converting means (21);

a reference voltage generator (23);

a processor (18) for distinguishing the running direction of vehicles based on the frequency change of ultrasonic wave; and a power amplifying speaker (26), wherein an output channel of the stereo FM receiving means (11) is operably coupled to a first input of a first analog switch (12) controlled by the processor (18), a second input of the first analog switch (12) is operably coupled to an output of the speech recording/reproducing means (25), the speech output of the first analog switch (12) is operably coupled to the speech recording/reproducing means (25), the reproducing output of the first analog switch (12) is operably coupled to power amplifying speaker (26), an identify code output of the first analog switch (26) is operably coupled to the remote control receiving means (13); the output of the remote control receiving means (13) is operably coupled to the remote control decoding means (14); the output of the remote control decoding means (14) is operably coupled to the quad-latch (15) of which an output in turn is operably coupled to the processor (18), and the other output of which is operably coupled to an input of a second analog switch (16); a resistor array (17) is operably coupled to the other input of the second analog switch (16); a gate level signal output of the second analog switch (16) is operably coupled to an input of a third analog switch (22), and another input of the third analog switch (22) is operably coupled to the output of the reference voltage generator (23); an output of the ultrasonic receiving means, which is composed of an ultrasonic receiving head (19) for receiving ultrasonic signals transmitted from the transmitter, the ultrasonic frequency selective amplifying means (20) for performing frequency selection and amplifying the output of the ultrasonic receiving head, and the frequency-voltage converting means (21) for receiving the output from the ultrasonic frequency selective amplifying means (20) and converting the output into digital pulse signals, is operably coupled to another input of the third analog switch (22); and another input of the speech recording/reproducing means (25) is operably coupled to the processor (18) via the first analog switch (12).

2. The traffic safety caution apparatus according to claim 1, wherein in said transmitter, said vehicle detection enabling means (1) includes a detecting microphone MIC, a sound detecting integrated circuit IC7, a transistor Q4 and a delay reset relay J; said stereo FM receiving means (3) includes a receiving antenna AN1, a stereo FM receiving integrated circuit IC1; said speech recording/reproducing means (4) includes a speech recording/reproducing integrated circuit IC4; said stereo encoding means (5) includes a stereo encoding integrated circuit IC6; said FM amplifying transmitting means (6) includes three transistors Q1 to Q3 and a transmitting antenna AN2; said ultrasonic frequency stabilization oscillating means (7) includes a crystal oscillator Y3, "NOT" circuits IC2/*b*, IC2/*c* and IC2/*d*, and a power transistor Q5; said ultrasonic transmitting head (8) includes an ultrasonic transmitting sensor Y4; and in said receiver, the stereo FM receiving means (11) includes a receiving antenna AN3 and a stereo FM receiving integrated circuit IC8; the analog switches (12, 16, 22, 24) includes an analog switch which is composed of a four-tap analog switch IC12 and a transistor Q7, and analog switches IC14, IC13 and IC21; the processor (18) is a microprocessor IC22; the speech recording/reproducing means (25) includes a speech recording/reproducing integrated circuit IC20; the remote control receiving means (13) includes a remote control demodulation integrated circuit IC18; the remote control decoding means (14) includes a remote control decoding integrated circuit IC7; the quad-latch (15) includes a dual D-type trigger integrated circuit IC15, IC16; the ultrasonic receiving head (19) includes a ultrasonic receiving sensor Y8; the ultrasonic frequency selective amplifying means (20) includes a plurality of operational amplifiers IC26, IC25 and IC24; the frequency-voltage converting means (21) includes a frequency-voltage converter IC23; the references voltages generator (23) includes a resistor R47 and a voltage stabilizing diode D39; and the power amplifying speaker (26) includes a power amplifying integrated circuit IC11 and a speaker SP.

3. The traffic safety caution apparatus according to claim 1 or 2, wherein in said transmitter, a speech recording/reproducing means (9) is operably coupled between the other output channel of the stereo FM receiving means (3) and the stereo encoding means (5), a recording/reproducing switch circuit (10) is operably coupled between the control signal input of the stereo FM receiving means (3) and the speech recording/reproducing means (4); and in said receiver, the other output channel of the stereo FM receiving means (11) is operably coupled to a MP3 player (27), one of the inputs of the MP3 player (27) is operably coupled to the processor (18), and the other input thereof is preferably coupled to the quad-latch (15), the output of the MP3 player (27) is operably coupled to the first analog switch (12).

4. The traffic safety caution apparatus according to claim 3, wherein in said transmitter, the speech recording/reproducing means (9) includes a speech recording/reproducing integrated circuit IC5; the recording/reproducing switch circuit (10) includes a "NOT" circuit IC2/*a* and an analog switch IC3; and, in said receiver, the MP3 player (27) includes a MP3 player IC10.

5. The traffic safety caution apparatus according to claim 4, wherein said receiver further comprises a weather detecting means including a sensor (29) for detecting weather and an analog switch (28) connected to the output of the sensor and controlled by the processor (18), and two control signal outputs of the analog switch (28) are operably coupled to the speech recording/reproducing means (25), the data output for the analog switch (28) is operably coupled to the processor (18), the power amplifying speaker (26) in said receiver is operably coupled to volume incrementing means (30) of which a control signal input is connected to an analog switch (24).

6. The traffic safety caution apparatus according to claim 5, wherein said sensor (29) in said receiver is a temperature sensor T, the analog switch (28) includes a four-tap analog switch IC19 and a transistor Q6, and the volume incrementing means 30) is a count dividing frequency integrated circuit IC9.

* * * * *